US009014581B2

(12) United States Patent
Regelsberger et al.

(10) Patent No.: US 9,014,581 B2
(45) **Date of Patent: *Apr. 21, 2015**

(54) PRINTER WITH UNFUSED TONER PROCESS CONTROL SYSTEM

(75) Inventors: Matthias Hermann Regelsberger, Rochester, NY (US); Thomas Allen Henderson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 420 days.

This patent is subject to a terminal disclaimer.

(21) Appl. No.: 13/435,344

(22) Filed: Mar. 30, 2012

(65) Prior Publication Data

US 2013/0259500 A1 Oct. 3, 2013

(51) Int. Cl.
*G03G 15/00* (2006.01)
*G03G 15/01* (2006.01)

(52) U.S. Cl.
CPC ..... *G03G 15/0105* (2013.01); *G03G 15/5062* (2013.01)

(58) Field of Classification Search
CPC G03G 15/00; G03G 15/0105; G03G 15/5062
USPC ..... 399/49
See application file for complete search history.

(56) References Cited

U.S. PATENT DOCUMENTS

| | | | | |
|---|---|---|---|---|
| 3,938,992 | A | 2/1976 | Jadwin et al. | |
| 3,941,898 | A | 3/1976 | Sadamatsu et al. | |
| 4,076,857 | A | 2/1978 | Kasper et al. | |
| 5,057,392 | A | 10/1991 | McCabe et al. | |
| 5,089,547 | A | 2/1992 | McCabe et al. | |
| 5,102,765 | A | 4/1992 | McCabe et al. | |
| 5,112,715 | A | 5/1992 | DeMejo et al. | |
| 5,119,132 | A | 6/1992 | Butler | |
| 5,147,747 | A | 9/1992 | Wilson et al. | |
| 5,296,895 | A * | 3/1994 | Naito | 399/49 |
| 5,780,195 | A | 7/1998 | Nava | |
| 5,873,011 | A * | 2/1999 | Takemoto et al. | 399/49 |
| 5,909,235 | A | 6/1999 | Folkins | |
| 6,561,643 | B1 | 5/2003 | Walker et al. | |
| 7,097,269 | B2 | 8/2006 | Collette et al. | |
| 7,218,386 | B2 * | 5/2007 | Alcock et al. | 356/71 |
| RE42,071 | E | 1/2011 | Nakayama | |
| 7,869,724 | B2 | 1/2011 | Yamasaki et al. | |
| 7,869,732 | B2 | 1/2011 | Barry et al. | |
| 8,781,353 | B2 * | 7/2014 | Regelsberger et al. | 399/74 |
| 2010/0054774 | A1 * | 3/2010 | Yamasaki et al. | 399/49 |
| 2013/0259499 | A1 * | 10/2013 | Regelsberger et al. | 399/49 |
| 2013/0259501 | A1 * | 10/2013 | Regelsberger et al. | 399/49 |
| 2013/0259510 | A1 * | 10/2013 | Regelsberger et al. | 399/74 |

FOREIGN PATENT DOCUMENTS

| | | |
|---|---|---|
| EP | 1 103 799 | 5/2001 |

OTHER PUBLICATIONS

HP Designjet Z6100-series Pritners: Optical Media Advance Sensor, Mar. 2007, Hewlett Packard Development Company, LP.

* cited by examiner

*Primary Examiner* — David Gray
*Assistant Examiner* — Geoffrey Evans
(74) *Attorney, Agent, or Firm* — Roland R. Schindler; Amit Singhal

(57) ABSTRACT

Toner printers are provided. In one printer a toner image is printed according to first printing instructions. An amount of toner in a target area of the toner image is determined and second printing instructions are generated causing the toner printer to print at least one subsequent toner image based upon the determined amount of first toner.

20 Claims, 13 Drawing Sheets

PRINTER WITH UNFUSED TONER PROCESS CONTROL SYSTEM

CROSS REFERENCE TO RELATED APPLICATIONS

This application relates to commonly assigned, copending U.S. application Ser. No. 13/435,283, filed Mar. 30, 2012 entitled: "METHOD FOR SENSING UNFUSED TONER"; U.S. application Ser. No. 13/435,382, filed Mar. 30, 2012 entitled: "TONER SENSOR MODULE", and U.S. application Ser. No. 13/435,363, filed Mar. 30, 2012 entitled: "PRINTER WITH UNFUSED TONER PROCESS CONTROL", each of which is hereby incorporated by reference.

FIELD OF THE INVENTION

This invention generally relates to process control systems for printers and is specifically concerned with a toner sensor system that is capable of accurately measuring unfused toner.

BACKGROUND OF THE INVENTION

A toner printer forms images by converting image data into printing instructions that define how much toner is to be applied to each portion of a receiver and by using the printing instructions to make a toner image. The toner image is transferred to a receiver and fused to form a toner print. During fusing, the toner is heated so that it spreads against the receiver to bond therewith.

The process of converting the image data into printing instructions assumes that the toner printer applies a consistent amount of toner in response to individual printing instructions. However, there are a wide variety of factors that can cause variations in the amount of toner that is applied to a receiver in response to printing instructions. These factors can include environmental factors such as ambient temperature and humidity, material variations such as variations in toner charging characteristics, and process variations such as wear and tolerances within the printer. Additionally, there are a variety of process set points such as primary charger set points, exposure set points, and toner concentration settings that can influence an amount of toner transferred to a receiver in response to a printing instruction.

Accordingly, toner printers typically include automatic process control systems that monitor the colors generated by a toner printer and that make adjustments to the set points used in the toner printer to ensure that the toner printer provides toner images having a consistent amount of toner in response to specific printing instructions.

In a conventional process control system a test patch is printed on a receiver according to a set of printing instructions that are expected to cause the test patch to have a particular color. The test patch is then fused and a reflective density of the test patch is measured. The measured reflective density is compared to an expected reflective density of the test patch and adjustments to printer set points are automatically made to correct any differences.

For example, in many toner printers, an in-line densitometer is used to make reflective density measurements test patches. An "in-line" densitometer refers to a densitometer that is mounted on the printer itself and which measures the reflective density of fused test patches on printed sheets moving through a paper path in the printer. Density measurements made by the in-line densitometer are transmitted to a digital color controller of the printer as the densitometer scans the moving sequence of test patches (which are typically a series of cyan, magenta, yellow, gray and black rectangles) on the printed test sheets. From the input provided by the in-line densitometer, a digital color controller in a toner printer can determine whether it is necessary to make adjustments in the amount of one or more toners applied in response to particular printing instructions.

FIG. 1 illustrates a conventional in-line densitometer 10 that measures reflection density. As is shown in FIG. 1, densitometer 10 has a light source 12 that emits a light L that is directed to illuminate a fused toner image 14 on a sheet 16. A portion of light L is absorbed by fused toner image 14 and sheet 16, a portion of light L is reflected as diffusely reflected light DRL and a portion of light L is reflected as specularly reflected light SRL that travels to light sensor 18.

FIG. 2 illustrates another example of a conventional in-line densitometer for measuring reflection density. In this example, densitometer 10 has light sensor 18 positioned to sense light that diffusely reflects from fused toner image 14 and sheet 16.

Conventional reflection type densitometry as illustrated in FIGS. 1 and 2 has a number of limitations. A first limitation is that reflection type densitometry cannot be accurately used to determine how much clear toner has have been fused to a receiver. This is because fused clear toner does not significantly impact the amount of light that reflects from the receiver and the reflective density measurements from an area having a large amount of fused clear toner do not differ significantly from reflective optical density measurements from an area having a relatively small amount of clear toner fused thereto.

A second limitation of reflective densitometry of the type that is illustrated in FIGS. 1 and 2 is that such conventional densitometry cannot be accurately used to measure how much unfused toner has been applied to a test patch of a receiver. There are a number of reasons for this. One reason for this is that unfused toner particles can be approximated as generally rounded objects that are positioned along the surface of a receiver. Therefore, toner particles reflect light in many different directions most of which are not in a path from a light source to a light sensor in a reflection density type of densitometer. When a reflection densitometer such as the one shown in FIG. 1 is used on an area having unfused toner, much of the light from the target area is reflected away from the light sensor and conclusions made based upon measurements made in this fashion can be misleading. Further, because toner particles rest on top of the receiver, light can be masked or trapped between the toner particles and the receiver creating optical effects that create uncertainty in as to whether differences in optical reflection measured made by a reflective densitometer of the type that is shown in FIG. 2 are indicative of differences in the amount of toner applied to a receiver or are indicative of such optical effects.

Additionally, it will be appreciated that unfused toner is disbursed over the surface area of receiver 26 in amounts that are calculated to form a particular color after the toner particles have been fused and spread so that the fused toner covers a greater portion of the receiver after fusing than before fusing. Therefore, any light received at a sensor from a test patch using conventional reflective densitometry will have a high proportion of light reflected from receiver 26. The light that is reflected by toner particles will generally be darker than the light that is reflected by the receiver. Further, the toner reflected light has lower intensity than the receiver reflected light. These characteristics of such reflected light limit the reliability with which a densitometer can discriminate between different amounts of unfused toner in a test patch.

Accordingly, conventional densitometers can only provide process control signals after a print has been printed and fused. This creates additional limitations in that process control determinations can only be made after the printing of an image is complete. Thus, where corrections are necessary, at least one print evidencing the need for such corrections must be made and recycled. Additionally, the measurements made by the densitometer can be impacted both by the fusing process and by the amount of toner in an area that is measured and it can be unclear whether corrections are to be made to set points for fusing or to the amounts of toner applied to a receiver.

For these reasons, conventional reflective densitometry measurements cannot be applied reliably to the measurement of unfused toner amounts and there remains a need in the art for an in-line system that can be used to reliably measure amounts of unfused toner that are applied to a receiver by a toner printer. Further, to reduce printer complexity and cost, it is desirable that such an in-line system be inexpensive and of efficient design while still overcoming all of the aforementioned disadvantages associated with prior art designs.

SUMMARY OF THE INVENTION

In one aspect, a toner printer is provided having a controller providing first printing instructions to cause a print engine to form a toner image on a surface having first toner in a target area and causing a toner print engine to print a toner image according to the first printing instructions, a first light source illuminating the target area of the printed toner image with a first light from a first illumination position that is on a first side of a plane that is normal to the target area, and a first light sensor sensing light at a sensing position on the first side of the plane to which toner particles at the target area direct a reflected portion of the first light into the first side. The controller determines from the sensed light an amount of a first toner in the target area and generates second printing instructions causing the toner printer to print at least one subsequent toner image based upon the determined amount.

DETAILED DESCRIPTION OF THE DRAWINGS

Figure 1:
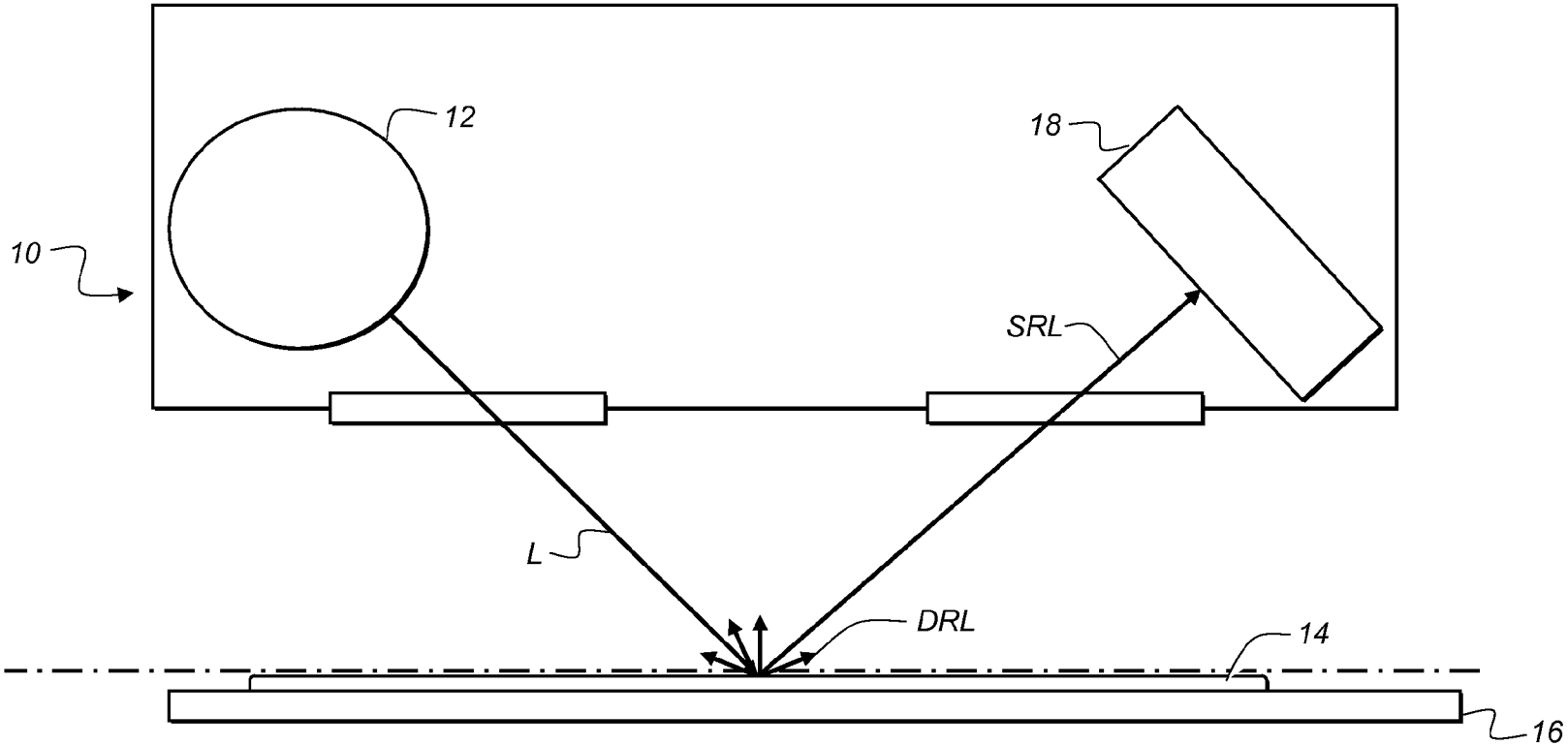
FIG. 1 (PRIOR ART)
FIG. 1 is schematic, side view of a paper transport section of a toner printer having a prior art in-line densitometer.
Figure 2:
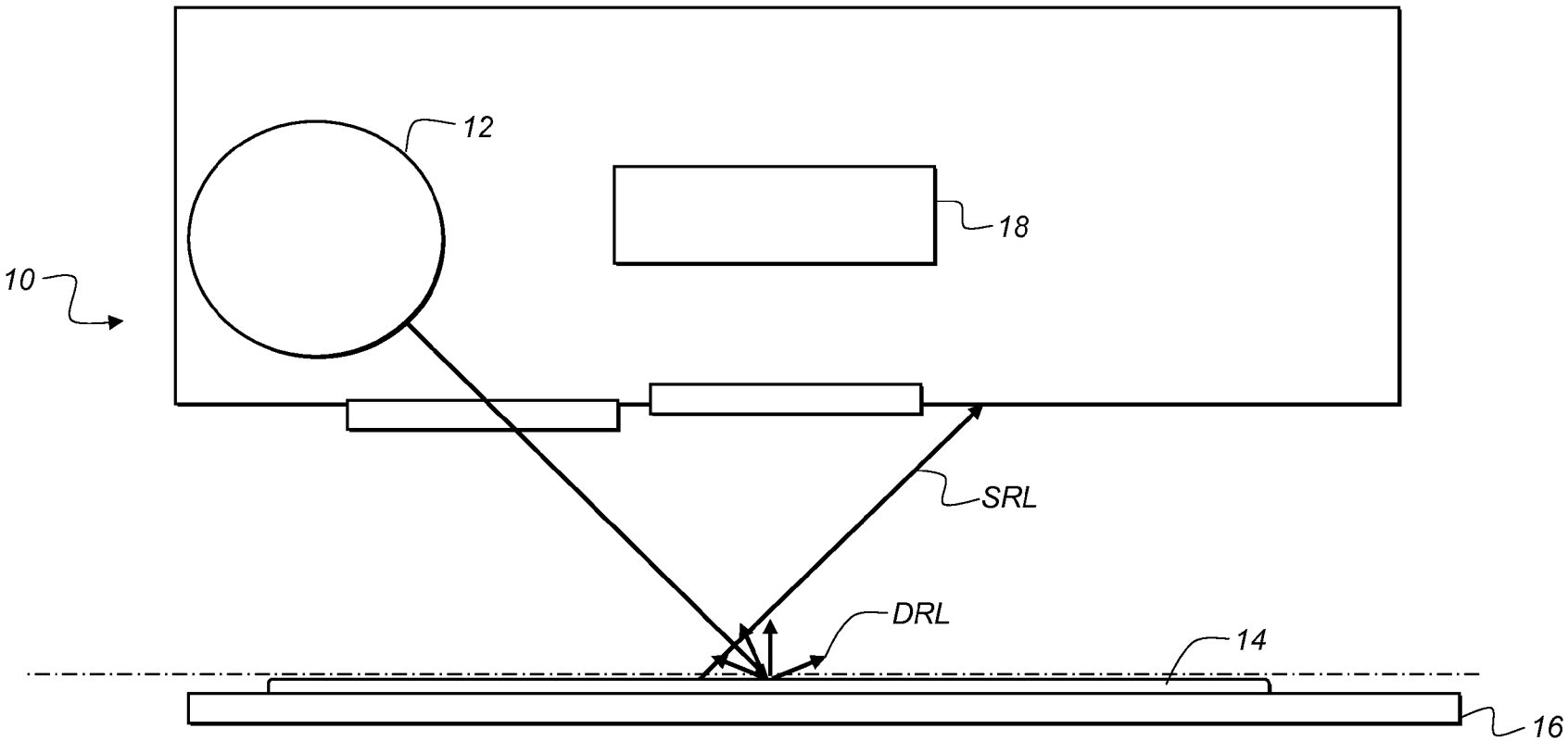
FIG. 2 (PRIOR ART)
FIG. 2 is a schematic, side view of a paper transport section of a toner printer having another prior art in-line densitometer.
Figure 3:
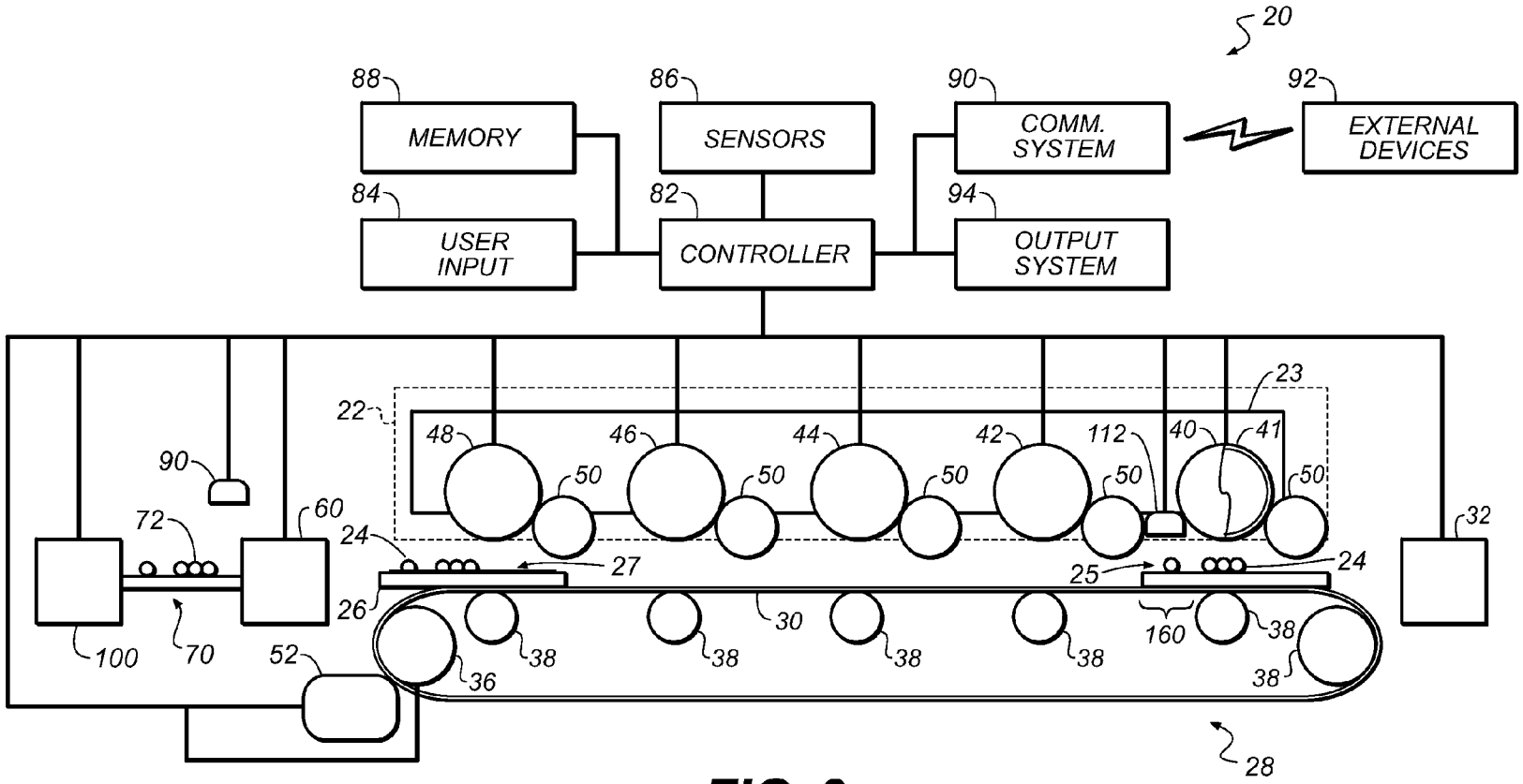
FIG. 3 illustrates one example of an electrophotographic printer.

FIG. 3 is a system level illustration of a toner printer 20. In the embodiment of FIG. 3, toner printer 20 has a print engine 22 that patterns a toner 24 to form a toner image 25. Toner image 25 can include any pattern of toner 24 and can be mapped according data representing text, graphics, photo, and other types of visual content, as well as patterns that are determined based upon desirable structural or functional arrangements of toner 24.

Toner 24 can include one or more binders which can be optionally colored by one or more colorants. Colorants can be pigments, dyes, and other limited wavelength light absorbers known in the art. Commonly in the printing industry binders are polymeric resins. The toner resin can any of a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. In certain embodiments, binders can include polyesters and polystyrenes. However, in other embodiments any other form of particulate material that can be patterned to form a toner image and that can be transferred and fused to a receiver 26 can be used as a binder. Toner particles can be without colorants and can provide, for example, a protective layer on an image or that impart a tactile feel or other functionality to the printed image. Toner 24 can also include a wax at least some of which can separate from the toner particles to reduce adhesion between the toner particles and a heated fuser roller. Toner 24 can be in the form of particles that are surface treated with coatings and or that have surface treatments to facilitate transfer, processing, handling or fusing.

In the embodiment of toner printer 20 illustrated in FIG. 3, a print engine 22 is used that is of the electrophotographic type. In this type of print engine 22, toner 24 takes the form of toner particles that are charged and developed in the presence of an electrostatic latent image to convert the electrostatic latent image into a visible image.

Toner particles can have any of a variety of ranges of median volume diameters, e.g. less than 8 μm, on the order of 10-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink.

Typically receiver 26 provided by a receiver supply 32 takes the form of paper, film, fabric, metal bearing films, metal bearing fabrics, or metallic sheets, fibers or webs, and can be made from naturally occurring materials or artificial materials. However, receiver 26 can take any number of forms and can comprise, in general, any article or structure that can be moved relative to print engine 22 and processed as described herein.

In the embodiment of FIG. 3, print engine 22 is used to deposit one or more patterns of toner 24 to form toner image 25 on receiver 26. A toner image 25 formed from a single application of toner 24 can, for example, provide a monochrome image or a first layer of a structure.

In the embodiment of FIG. 3, print engine 22 is illustrated as having an optional arrangement of five printing modules 40, 42, 44, 46, and 48, arranged along a length of receiver transport system 28. Each printing module delivers a single toner image 25 to a respective transfer subsystem 50 in accordance with a desired pattern as receiver 26 is moved by receiver transport system 28. A composite toner image 27 is formed by combining two or more toners having two or more toner images 25 in registration. A composite toner image 27 that is formed in this manner can be used for a variety of purposes, the most common of which is to provide a composite toner image 27 which a plurality of toners are placed at a common location so that the toners will combine upon fusing to provide any of a wide range of colors. For example, a toner image 27 can include four toners 24 having subtractive primary colors, cyan, magenta, yellow, and black. Any of these four colors of toner 24 can be combined with toner 24 of one or more of the other colors at a particular location on receiver 26 to form any of a wide range of colors that are different than the colors of the individual toners 24 combined at that location. Similarly, in a five toner image various combinations of any of five differently colored toners 24 can be combined to form other colors on receiver 26 at various locations on receiver 26. In FIG. 3, this outcome is suggested by the combination of white toner particles with black toner particles to form a composite toner image 27.

Receiver transport system 28 comprises a movable surface 30 that moves receiver 26 relative to printing modules 40, 42, 44, 46, and 48. Surface 30 comprises an endless belt that is moved by motor 36, that is supported by rollers 38, and that is cleaned by a cleaning mechanism 52.

In the embodiment of FIG. 3 printing modules 40, 42, 44, 46, and 48 can each have a primary imaging member such as primary imaging drum 41 (shown in part in cutaway in first toner printing module) on which a toner image 25 can be formed using an electrophotographic process. In one example of the electrophotographic process, the primary imaging member is as a photoreceptor that is initially charged to a generally uniform difference of potential relative to a ground. An electrostatic latent image is formed by image-wise exposing the photoreceptor to a light pattern using known methods such as optical exposure, an LED array, or a laser scanner (not shown). The photoreceptor discharges the uniform difference of potential at each illuminated spot in an amount that is a function of the intensity of the light applied to the photoreceptor so that an electrostatic latent image can be formed. The electrostatic latent image is developed into a visible image by bringing the primary imaging member into close proximity to a development station (not shown) that contains a charged toner 24. A development potential is applied at the development station that causes charged toner 24 to develop on the primary imaging member (not shown) according to the electrostatic latent image at each engine pixel location. This forms toner image 25 on the primary imaging member.

Each toner image 25 is transferred to a respective transfer subsystem 50, and the respective transfer subsystems transfer the toner images against receiver 26. Optionally an electromagnetic field can be used to urge a toner image 25 to transfer from primary imaging member to transfer subsystem 50 or from a transfer subsystem 50 onto receiver 26. In other embodiments, printer 20 can use a print engine 22 that forms a composite toner image 27 on receiver 26 in any other manner consistent with what is claimed herein.

After toner image 25 is transferred to receiver 26, receiver 26 is moved by receiver transport system 28 to fuser 60. Fuser 60 brings the toner image 25 to a glass transition temperature and optionally pressures the toner against the receiver 26 so that the toner spreads against the receiver to bond therewith. This spreading of the toner further increases the portion of receiver 26 that is covered with toner and allows the toner to influence the amount color in areas of the receiver that are outside of the discrete engine pixel locations.

As is shown in FIG. 3, after fusing, a print 70 having a fused toner image 72 can be transported from fuser 60 to an optional finishing system 100 where stacking, collating, stapling, cutting, binding or other finishing options can be performed. An optional reflection densitometer 90 is also shown between fuser 60 and finishing system 100 which can be used by printer controller 82 for process control purposes as will be described in greater detail below.

Figure 4:
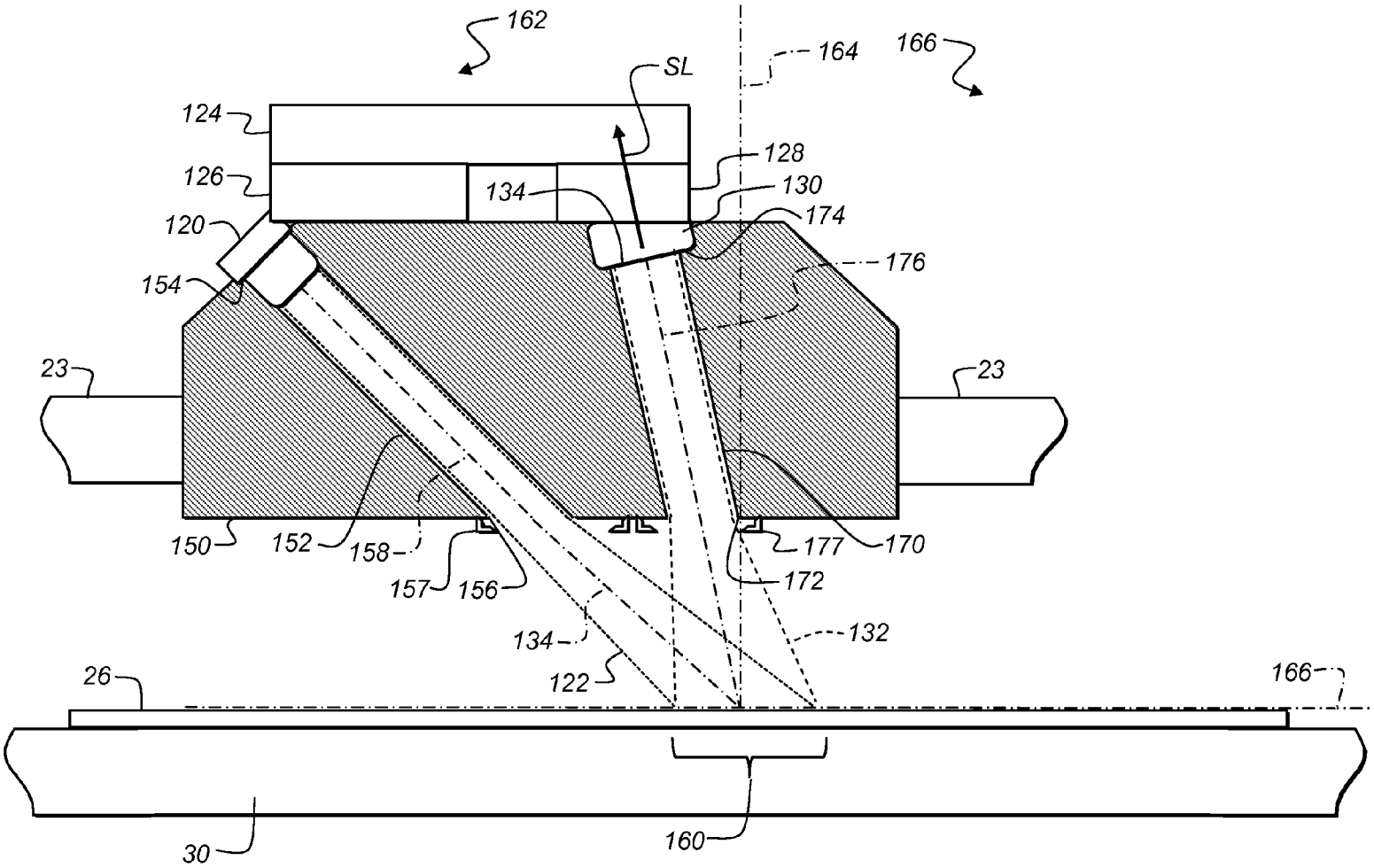
FIG. 4 is a cross sectional view of one embodiment of a toner sensor module of FIG. 3.

Toner printer 20 has a toner sensor module 112 between first printing module 40 and second printing module 42. FIG. 4 shows a first embodiment of a toner sensing module 112. As is shown in the embodiment of FIG. 4, toner sensing module 112 has a first light source 120 emitting a first light 122, a first light sensor 130 that generates a sensed light signal SL that is indicative of a sensed light and a frame 150 that positions first light source 120 and first light sensor 130. Printer controller 82 operates printer 20 based on input signals from a user input system 84, sensors 86, a memory 88 and a communication system 900. Printer 20 further comprises an output system 94. The communication system can comprise any form of circuit, system or transducer that can be used to send signals to or receive signals from memory 88 or external devices 92 (see, for example, U.S. Pat. No. 8,431,313).

As is shown in FIG. 3 and in FIG. 4, frame 150 is joined, for example, to a chassis 23 that is used to position printing modules 40-48. In the example illustrated in FIGS. 3 and 4, frame 150 is mounted between first printing module 40 and second printing module 42. In other embodiments frame 150 can be mounted to first printing module 40 or second printing module 42. In other embodiments, frame 150 can be free standing or mounted to or joined to other components of printer 20 so long as frame 150 can position first light source 120, first light sensor 130 to illuminate a target area 160. In this embodiment, target area 160 is along movable surface 30 so that a receiver 26 having an unfused toner image 25 having an area to be measured can be moved into target area 160 is located during printing operations.

Frame 150 positions first light source 120 so that first light 122 illuminates target area 160 from a first side 162 of a plane 164 that is normal to a target plane 168 that extends along target area 160. In this embodiment, frame 150 includes a cylindrical first bore 152 having an opening 154 to receive first light source 120 to direct first light 122 from first light source 120 along a first illumination direction 158 to an exit 156 from which first light 122 travels to illuminate target area 160.

First light source 120 can take any of a variety of forms. One example of first light source 120 is a white LED, which can be a model number NSPW500CS Bright White LED sold by the Nichia Corporation located in Tokyo, Japan. One advantage of such an embodiment of a light source is that white or pan-chromatic light is capable of providing a broad range of visible light wavelengths. In other embodiments first light source 120 can take other forms and can include incandescent, fluorescent, organic light emitting diode sources, polymeric light emitting diodes, and any other light sources that provide light in response to electrical signals and that have any known range of wavelengths.

First light source 120 is controlled by a light control circuit 126 of a control system 124. Light control circuit 126 can incorporate any circuits or systems known in the illumination control arts art for controlling characteristics of first light 122 including but not limited to circuits to control the timing of emission of first light 122, a duration of first light 122, and an intensity of first light 122. Examples of such circuits include but are not limited to strobe and flash circuits, switching circuits, relays, dimming circuits, pulse width modulation circuits and amplifiers.

In some embodiments, light control circuit 126 can include circuits that can be used to control the wavelengths or colors of first light 122. In this regard, first light source 120 can include a plurality of different light emitters with each having a different color. These different wavelengths can be selectively activated by light control circuit 126 to cause first light 122 to form a panchromatic light or a multi-chromatic light having combinations of light from a plurality of different sources having different spectra. Alternately, a first light source 120 can have a panchromatic light emitter and a dynamic filtering system such as a liquid crystal display to selectively filter the panchromatic light.

First bore 152 can be adapted to condition first light 122. In certain embodiments of this type, first bore 152 can be filled or partially filled with materials or can provide reflective surfaces to help combine and homogenize light from first light source 120. In other embodiments first bore 152 optionally can be adapted to be more or less reflective, or more or less, absorptive at particular wavelengths so as to condition first light 122. In still other embodiments first bore 152 can be adapted with fittings such as mountings 157 to allow one or more optical elements to be positioned in the path of first light 122 to condition first light 122. Examples of such optical elements include but are not limited to filters that condition first light 122 so as to cause first light 122 to have a polarization, color shift or one or more lens systems to shape first light 122.

As is also shown in FIG. 4, frame 150 also positions first light sensor 130 on first side 162 of plane 164 so that first light sensor 130 senses a portion of first light 122 that is scattered from target area 160 toward first side 162.

In this embodiment, frame 150 includes a cylindrical second bore 170 having an inlet 172 on first side 162 to receive light reflected from target area 160. When target area 160 is illuminated by first light 122 from a first illumination position that is on a first side of a plane that is normal to a target area illuminated portions of any toner particles at the target area reflect a portion of the first light into the first side. As will be discussed in greater detail below, frame 150 positions first light source 120 and first light sensor 130 such that first light sensor 130 is positioned on first side 162 of the plane to which particles of toner 24 at target area 160 direct the reflected portion.

In this embodiment, first light source 120 is positioned at opening 154 of first bore 152 and is separated from exit 156 by a length of first bore 152. This helps to shape and to control the pattern of first light 122 so that it illuminates target area 160.

As is shown in the embodiment of FIG. 4, first reflected light 132 is that portion of first light 122 that reflects into inlet 172. Second bore 170 guides first reflected light 132 along a sensing direction 176 to first light sensor 130 that is positioned at a mounting end 174 of second bore 170. As is shown in this embodiment, first light sensor 130 is positioned in a mounting 174 that is separated from inlet 172 by a length of second bore 170 such that second bore 170 acts as an aperture to help to limit first reflected light 132 to that which reflects from a sample space for a target area 160.

In the embodiment shown in FIG. 4, first light sensor 130 has a sensing surface 134 that can sense first reflected light 132 and that can generate a sensed light signal SL based upon the intensity of first reflected light 132. First light sensor 130 can take any of a variety of forms. For example, first light sensor 130 can comprise a photovoltaic cell, a photo transistor, or any other known transducer that produces a signal having a range of differentiable states that are indicative of the of a range of different of light intensity levels incident on sensing surface 134.

In certain embodiments first light sensor 130 has a sensing surface 134 with a single sensing area or an array of sensing areas that are used in combination to generate a sensed light signal SL that is representative of an average intensity or exposure of sensing surface 134 to first reflected light 132. In other embodiments, first light sensor 130 can have a sensing surface 134 with an array of sensing areas that are adapted to sense different colors or types of light within first reflected light 132 and to provide a sensed light signal SL that reflects the intensity of first reflected light 132 in the colors or types of light that the difference sensing areas are adapted to sense.

For example, first light sensor 130 can have three sensing areas that are adapted to sense respectively red light components, blue light components, and green light components in first reflected light 132 and the sensed light signal SL can be in one of a plurality of differentiable states that are indicative of the intensity or exposure of the red, green, and blue sensing areas to the red, green, and blue components of the first reflected light 132. It will be appreciated from this that other arrangements of sensing areas can be used and that sensed light signals can be provided.

In the embodiment that is illustrated in FIG. 4, sensed light signals SL generated by first light sensor 130 are provided to a light sensing circuit 128 in control circuit 124. Light sensing circuit 128 can include circuits for processing the sensed light signal such as filters, amplifiers, and other signal processing circuits as well as comparators, voltage measuring circuits, energy storage circuits such as capacitors or batteries, and other circuits useful in processing the sensed light signal SL so that the sensed light signal SL can be used by control circuit 124 or by printer controller 82 to determine an amount of toner developed at target area 160. Where the sensed light signal SL is to be provided to printer controller 82 control circuit 124 can provide comparators and converters necessary to convert the sensed light signal into a digital form and communication circuits to otherwise process the sensed light signal SL so that it can be conveniently conveyed to printer controller 82 in a form that can be used thereby.

In other embodiments, second bore 170 can be adapted to condition first reflected light 132. In certain embodiments of this type, second bore 170 can be filled or partially filled with materials to help condition first reflected light 132 such as by filtering, mixing, or absorbing and reemitting first reflected light 132. In other embodiments second bore 170 can also be adapted to be more or less reflective, or more or less, absorptive at particular wavelengths, or to absorb and then to re-emit some all of first reflected light 132 so as to condition first light 122. In still other embodiments second bore 170 can be adapted with fitting such as mountings 177 to allow one or more optical elements to be positioned between target area 160 and first light sensor 130 to condition first reflected light 132. Examples of such optical elements include but are not limited to filters that condition first light 122 so as to cause first reflected light 132 to have a polarization, color shift or one or more lens systems to shape first reflected light 132.

Figure 5:
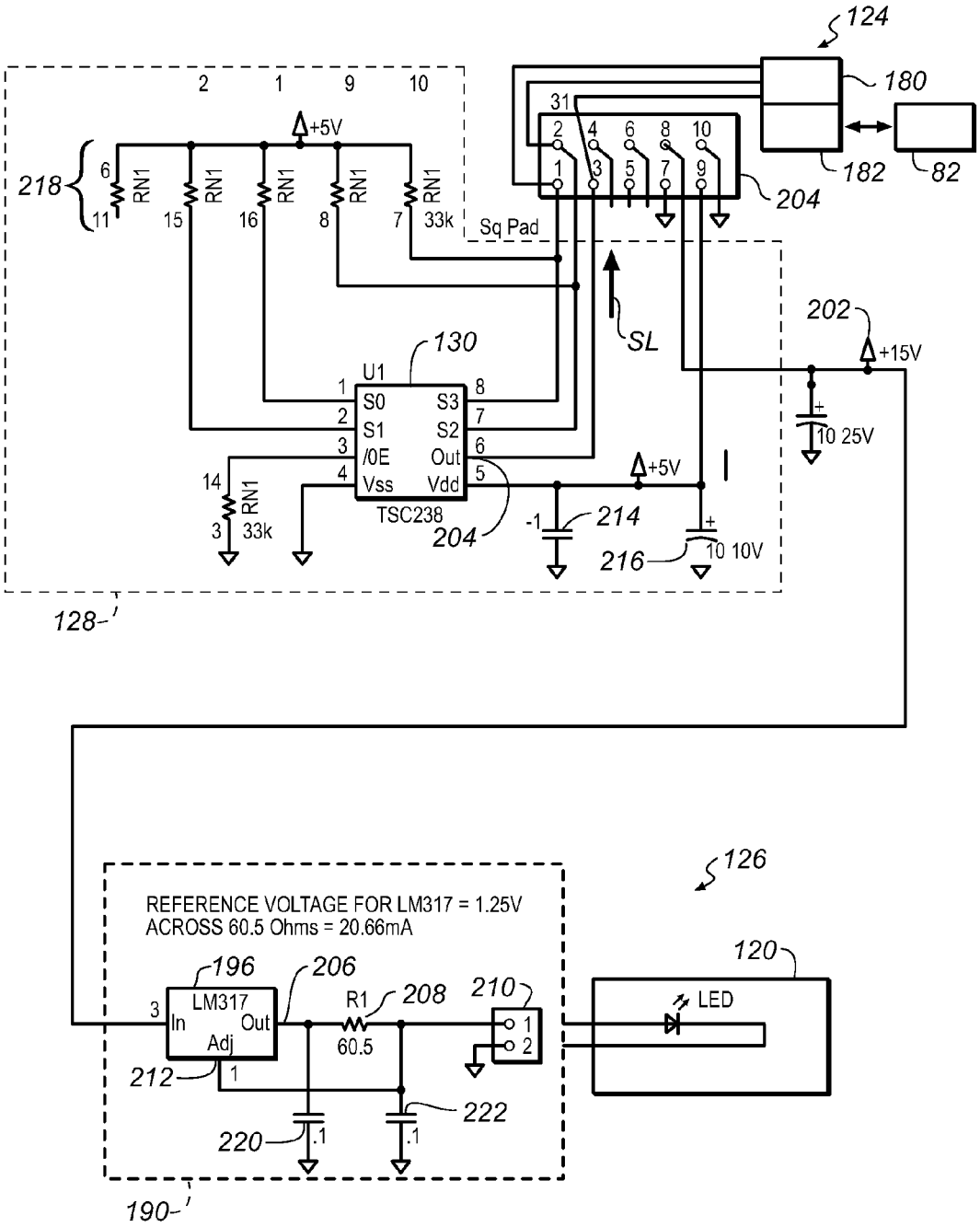
FIG. 5 is a schematic view of one embodiment of a circuitry used in the densitometer toner sensor module of the invention.

FIG. 5 illustrates in one embodiment a control circuit 124, light control circuit 126 and light sensing circuit 128 that can be used in conjunction with toner sensor module 124. In this embodiment, control circuit 124 includes a logic control unit 180 and a communication circuit 182. Logic control unit 180 can take any form of, for example, a digital microprocessor, logical control device, programmable logic controller, a programmable analog device, or a hardwired arrangement of circuits and or circuit components that can perform the functions described herein including but not limited to synchronizing and determining when and how first light source 120 is to be generated and when and how first light sensor 130 is to sense light, sending appropriate control signals to light control circuit 126 to cause light control circuit 126 to illuminate a target area 160 with a first light 122 and, if necessary, to cause first light sensor 130 to sense a first reflected light 132 and to provide a sensed light signal SL to logic control unit 180.

In the embodiment that is illustrated in FIG. 5 light control circuit 126 includes a constant current circuit 190 including a current control circuit 196 which, in the preferred embodiment, is a LM317 IC manufactured by National Semiconductor located in Santa Clara, Calif. One input 200 of the current control circuit 196 is connected to a 15 volt input 202 shown here as being provided from an optional socket that connects constant current circuit 190 and a sensing circuit 198 to a logic control unit 180 of control circuit 124. A power output 206 of current control circuit 196 is serially connected to a connector 210 by way of a precision resistor 208, which (in combination with the other components of the LM317 IC) reduces the voltage of the power received from 15 volt input 202 to about 1.25 volts. Connector 210 is in turn connected to first light source 120 which in this embodiment is shown as a light emitting diode.

In the embodiment of FIG. 5, light sensing circuit 128 has first light sensor 130 that takes the form of a Taos TSC230 sensor integrated circuit manufactured by Texas Advanced Optoelectronic Solutions, Inc., located in Plano, Tex. Output 204 of this embodiment of first light sensor 130 is a sensed light signal SL in the form of a square wave or pulse train whose frequency is linearly proportional to light intensity and features a dynamic range of 120 dB. In this embodiment of first light sensor 130 is a sensing surface 134 that includes an array of phototransistors (not shown) masked with a red, green, and blue color filter so that equal numbers of the phototransistors generate separate square wave pulse trains corresponding to an intensity of red, green and blue components of first reflected light 132.

Sensing circuit 198 further includes a resistor bank 218 for adjusting the voltages of digital control signals received from logic control unit 180 to the 0 and 5 volt levels recognizable as "0" and "1" control signals by this embodiment of first light sensor 130. These digital control signals are conducted to the S2 and S3 pins of first light sensor 130 as shown. Additionally, output 204 of first light sensor 130 is connected to an input of the control circuit 124 so that the control circuit 124 can determine the intensity of the perceived color components in a manner which will be explained in more detail hereinafter. Finally, capacitors 214 and 216 are included to stabilize a voltage of the digital control signals received by first light sensor 130 via resistor bank 218.

In operation, current control circuit 196 continuously monitors a voltage drop across precision resistor 208 via second input 212 and continuously adjusts the voltage of its output so that the current conducted to first light source 120 via the connector 210 remains constant. Capacitors 220 and 222 are connected as shown to filter out high frequency noise from second input 212 of current control circuit 196. The output 204 of first light sensor 130 is connected to an input of logic control unit 180 and provides a sensed light signal with information for each the colors sensed by first light sensor 130 so that that logic control unit 180 can determine the intensity of the perceived color components of first reflected light in a manner which will be explained in more detail below. Finally capacitors 220 and 222 are connected as shown to filter out high frequency noise from the input of the current control circuit 196.

The provided to logic control unit 180 which can perform any additional processing desired and can use communication circuit 182 to transmit the processed sensed light signal SL to printer controller 82. Alternatively, logic control unit 180 can cause communication circuit 182 to convey a sensed light signal SL to printer controller 82 in the form of any signal from which printer controller 82 can determine an amount of toner at the surface. Communication circuit 182 can provide a physical or other logical connection between logic control unit 180 and printer controller 82 for transmitting signals thereto and optionally for receiving signals therefrom. Communication circuit 182 can also comprise any known device for encoding or packaging data or information for transmission to printer controller 82 and optionally for receiving signals from printer controller 82 including well systems for transmitting and optionally receiving data using ethernet, local area networks, wireless communication circuits and systems and any other useful communication circuits or systems.

Figure 6:
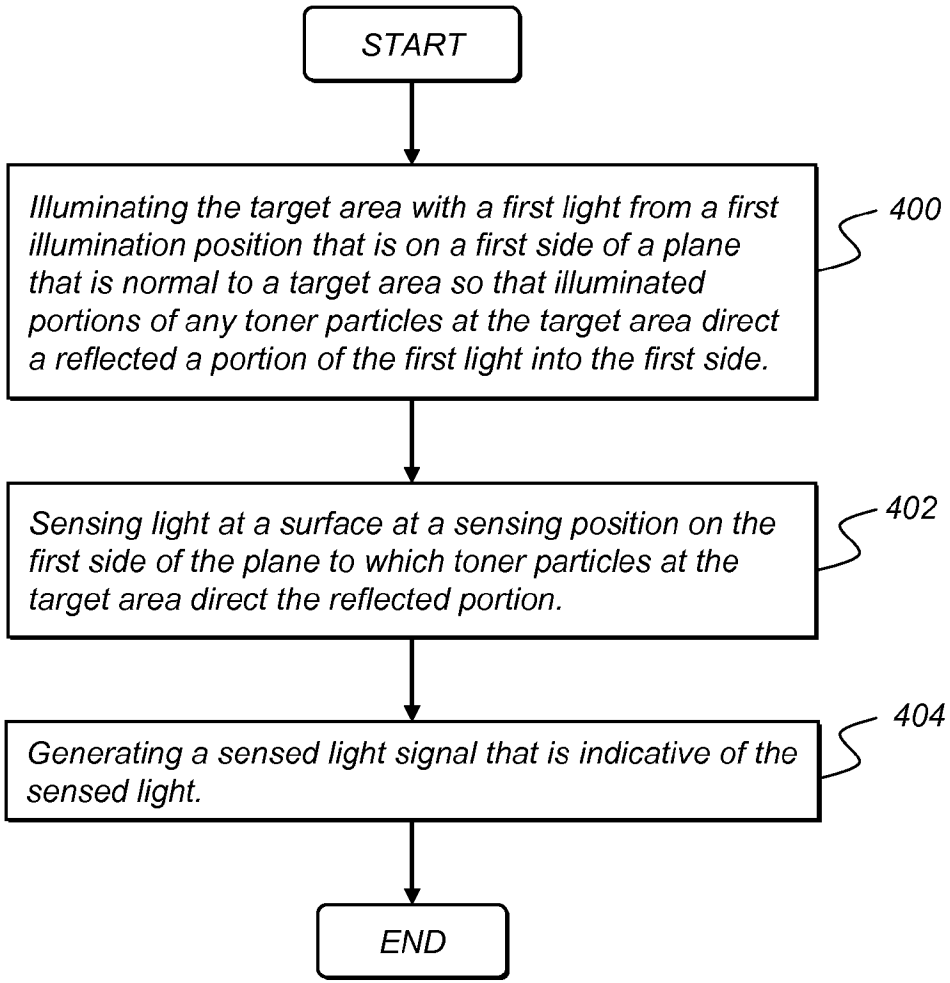
FIG. 6 shows a first embodiment of a method for determining an amount of toner in a target area.

FIG. 6 shows a first embodiment of a method for determining an amount of toner in a target area 160 that can be executed, for example, by control circuit 124 of toner sensing module 112. As is shown in FIG. 6, a target area is illuminated with a first light from a first illumination position on a first side of a plane that is normal to the target area so that illuminated portions of any toner particles at the target area reflect a portion of the first light into the first side (step 400) and light is sensed at a sensing position on the first side of the plane to which toner particles at the target area direct the reflected portion (step 402).

Figure 7:
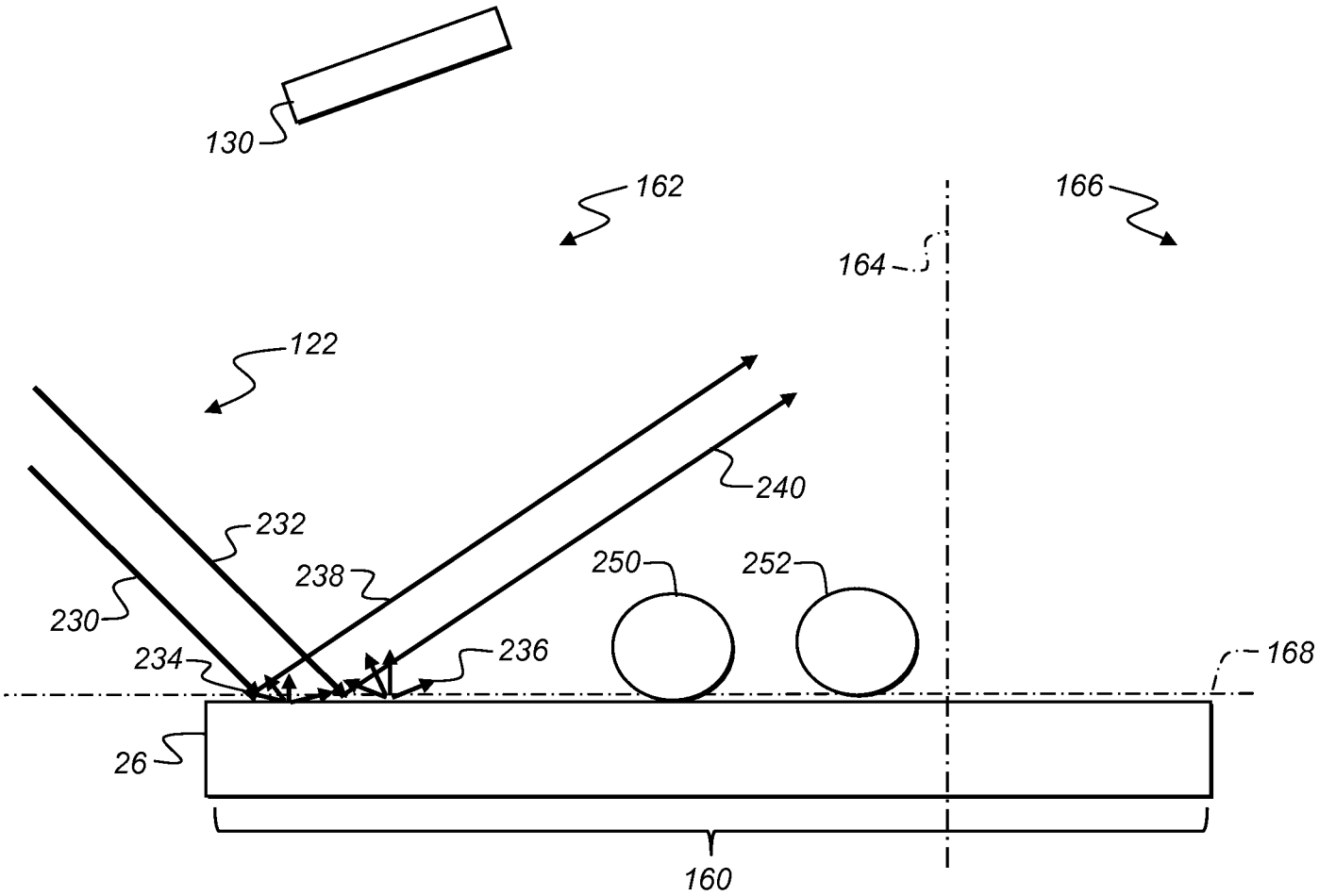
FIG. 7 provides a simplified illustration of light travel paths that arise using a toner sensing module.
Figure 8:
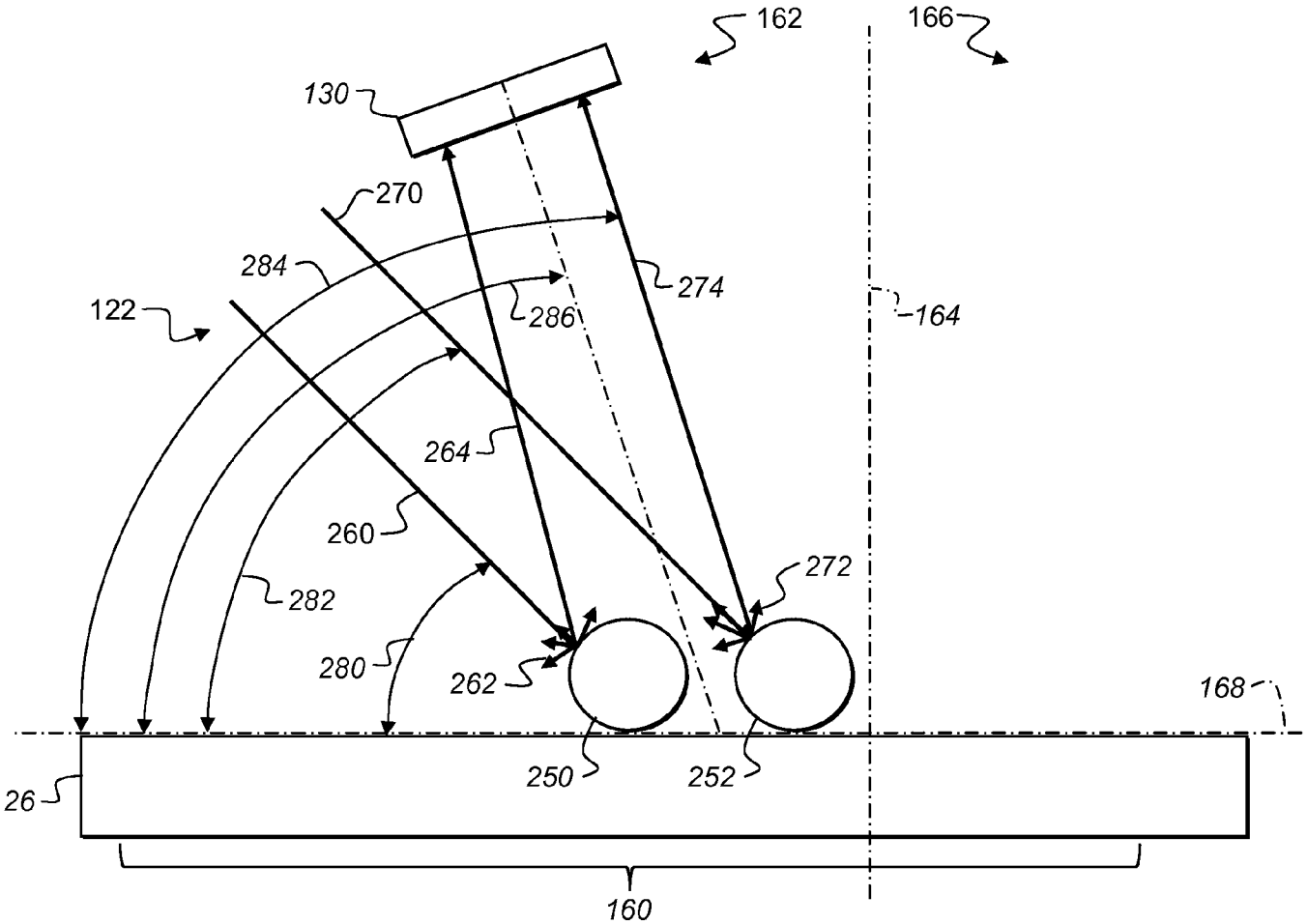
FIG. 8 provides a simplified illustration of additional light travel paths that can arise when a toner sensing module is used.

FIGS. 7 and 8 provide a simplified illustration of light travel paths that arise when toner sensing module 112 is used to illuminate a target area 160 having a toner particles therein. FIGS. 7 and 8 are not to scale and illustrate toner particles 250 and 252 as round objects for simplicity. It will be appreciated that particles of toner 24 such as toner particles 250 and 252 can be rounded, oblate, spheroidal, ovular, and can also be faceted in any number of configurations and can have any number of regular or irregularly shaped facets and can otherwise take on any other form of a toner particle known in the art.

As is illustrated in FIG. 7, a first set of rays 230 and 232 of first light 122 travels to target area 160, strike receiver 26 and are, in part, absorbed by receiver 26. The unabsorbed portions of rays 230 and 232 are in part diffusely reflected by receiver 26 as rays 234 and 236 and are in part reflected by receiver 26 in a specular manner as rays 238 and 240. As is suggested here by the comparative thickness and length of rays 230, 232, 234, 236, 238 and 240, in a situation such as the one illustrated here, where receiver 26 is generally flat, much of the light from rays 230 and 232 is reflected as specularly reflected rays 238 and 240 which travel into second side 166.

FIG. 8 shows the same arrangement of as is shown in FIG. 7 and illustrates the interaction between toner particles 250 and 252 and second rays 260 and 270 of first light 122. As is shown in FIG. 8, second rays 260 and 270 strike toner particles 250 and 252 that are positioned in target area 160. In this illustration, second rays 260 and 270 travels in parallel toward toner particles 250 and 252 at a common illumination angle 280 however this is not critical.

When second ray 260 strikes toner particle 250, a portion of the light from second ray 260 is absorbed by toner particle 250 or any colorants therein or transmitted through toner particle 250 (not shown). Other portions of first light 122 are reflected into first side 162 as rays 262 and 264. As is shown here, ray 282 travels in along first reflection angle 264 to light sensor 130 while rays 262 travel in other directions.

Similarly, when second ray 272 strikes toner particle 252, a portion of the light from second ray 270 is absorbed by toner particle 252 or any colorants therein or transmitted through toner particle 252 (not shown). Other portions of first light 122 are reflected into first side 162 as rays 272 and 274. As is shown here, ray 274 travels along reflection angle 284 to first light sensor 130.

As is shown here, reflection angles 282 and 284 are not equal. However, both reflected rays 264 and 274 travel on paths that lead to first light sensor 130.

It will be appreciated that when toner particles such as toner particles 250 and 252 in target area 160 are illuminated in the manner described herein, these toner particles direct much of the reflected portion of first light 122 into first area 162. In contrast, receiver 26 (or any other surface in a target area 160) will direct much of any light reflected by receiver 26 in a specular manner into second side 166. In this way, the amount of first light 122 that is reflected from target area 160 to first light sensor 130 is principally a function of the amount of toner particles in target area 160 and first light sensor 130 can generate a sensed light signal SL that is indicative of an amount of toner in target area 160 and that has a high signal-to-noise ratio (step 404).

In one example embodiment, a frame such as frame 150 of FIG. 4 positions first light source 120 so that first light 122 travels to the target area 160 at an illumination angle 280 that is between about 40 to about 50 degrees measured from a portion of target plane 168 on first side 162 of the plane 164 that is normal to the target area 160 and wherein frame 150 positions first light sensor 130 at a sensing angle 286 that is from about 80 degrees to less than 90 degrees measured from a portion of target plane 168 on first side 162 of plane 164 that is normal to target area 160 in order to sense toner particles that are, for example, between 4 um and 20 um.

There are other ways in which the signal-to-noise ratio of sensed light signal can SL be further enhanced. In one embodiment, this can be done by making the system proportionately more sensitive to light that has a color that is the same as that of the toner. For example, in one embodiment, first light 122 can be monochromatic or multi-chromatic and can be selected to provide a first light 122 that has a color that is close to a color of the toner. First light sensor 130 can have a sensing surface 134 that is sensitive to colors that are similar in color to the colorant of the toner that will be sensed. For example, if first printing module 40 deposits a cyan toner, first light 122 can have a blue coloration and first light sensor 130 can be made to be sensitive to blue light other colors in first reflected light 132 are filtered and create little or no noise in the sensed light signal.

In one example embodiment, such a blue light can be provided by an embodiment of first light source 120 that is a multi-chromatic light source while in other embodiments a blue light source or a blue filtered light source can be used. Similarly, first light sensor 130 can be of a type that has different sensing areas for sensing different types of reflected light and sensing area or combination of sensing areas that are adapted to sense blue can be used for the sensed light signal. Alternatively, a monochrome sensor can be used with a filter that filters one or more colors other than blue.

As is discussed above, clear toners are generally considered to be difficult to sense using a conventional reflection densitometer. However, it will be understood that a toner that is perceived to be colorless will typically comprise some type of clear binder material and as described above, conventional in-line reflection densitometers typically cannot be used reliably to determine an amount of such clear toner that has been applied to a surface because, fused clear toner does not change optical reflection density to an extent that allows discrimination between areas having lower amounts of clear toner and areas having higher amounts of clear toner.

However, unfused clear toners have a white appearance. Accordingly, unfused clear toner particles have specular reflection characteristics on first side 162 that are similar to unfused toner particles having colorants therein and reflect a portion of first light 122 in a specular manner and that specular reflections from clear toner particles in a target area 160 will travel to and can be sensed using first light sensor 130 as is generally described above. Accordingly, using toner sensing module 112, it is possible to determine an amount of clear toner provided on a receiver during a toner printing process.

Figure 9:
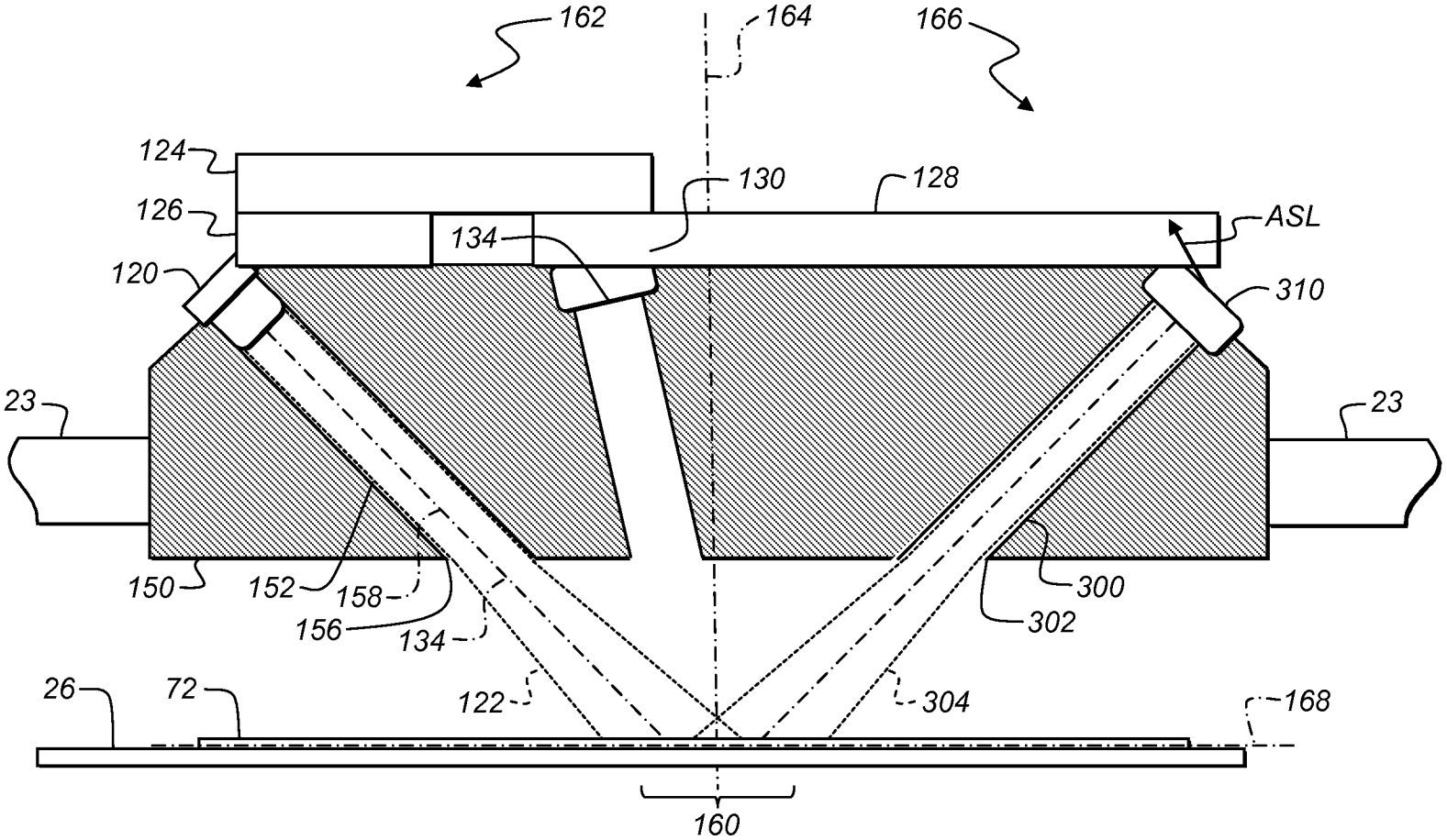
FIG. 9 illustrates another embodiment of a toner sensing module.

FIG. 9 shows another embodiment of toner sensing module 112 having a third bore 300. As is shown in the embodiment of FIG. 9, third bore 300 is positioned on a second side 166 of a plane 164 that is normal to target area 160 and has an opening 302 positioned to receive second reflected light 308 that reflects from a fused toner image 72 at target area 160 and that guides second reflected light 308 to a second light sensor 310. Second light sensor 310 is connected to light sensing circuit 128 and provides an alternate sensed light signal ASL thereto so that the alternate sensed light signal ASL can be used as a reflective optical density measurement that can be processed and used for densitometry purposes by control circuit 124 or printer controller 82. In this way, printer 20 can be provided with reduced costs and complexity by incorporating many copies of toner sensing module 112 that can be used both for sensing amounts of unfused toner prior to fusing and alternatively as a densitometer 90. Optionally, in such an embodiment, frame 150 can have a second bore 170 and a third bore 300 arranged such that first light sensor 130 can be repositioned between second bore 170 and third bore 300 based upon the function that toner sensing module 112 is to perform.

Figure 10A:
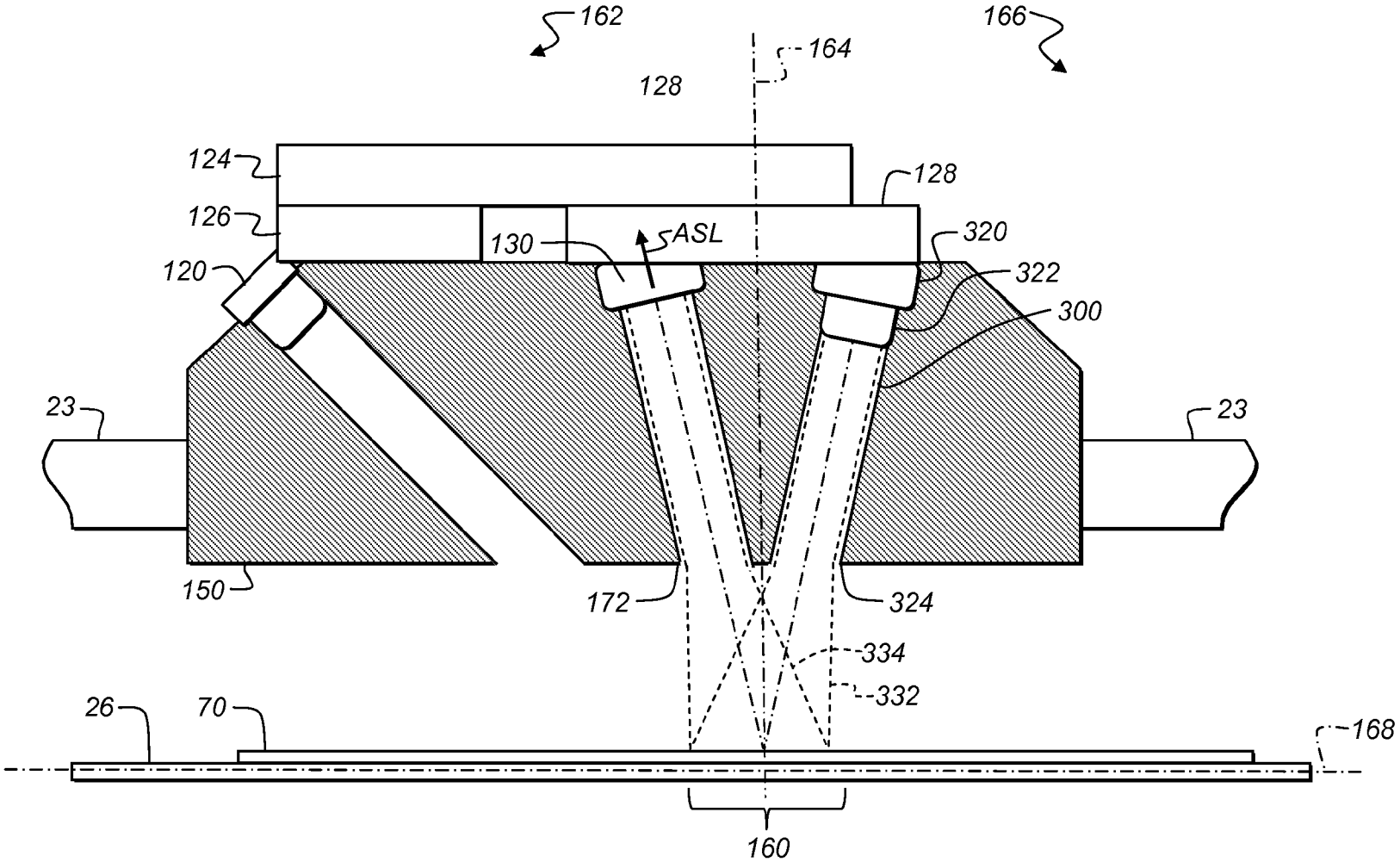
FIG. 10A illustrates another embodiment of a toner sensing module.
Figure 10B:
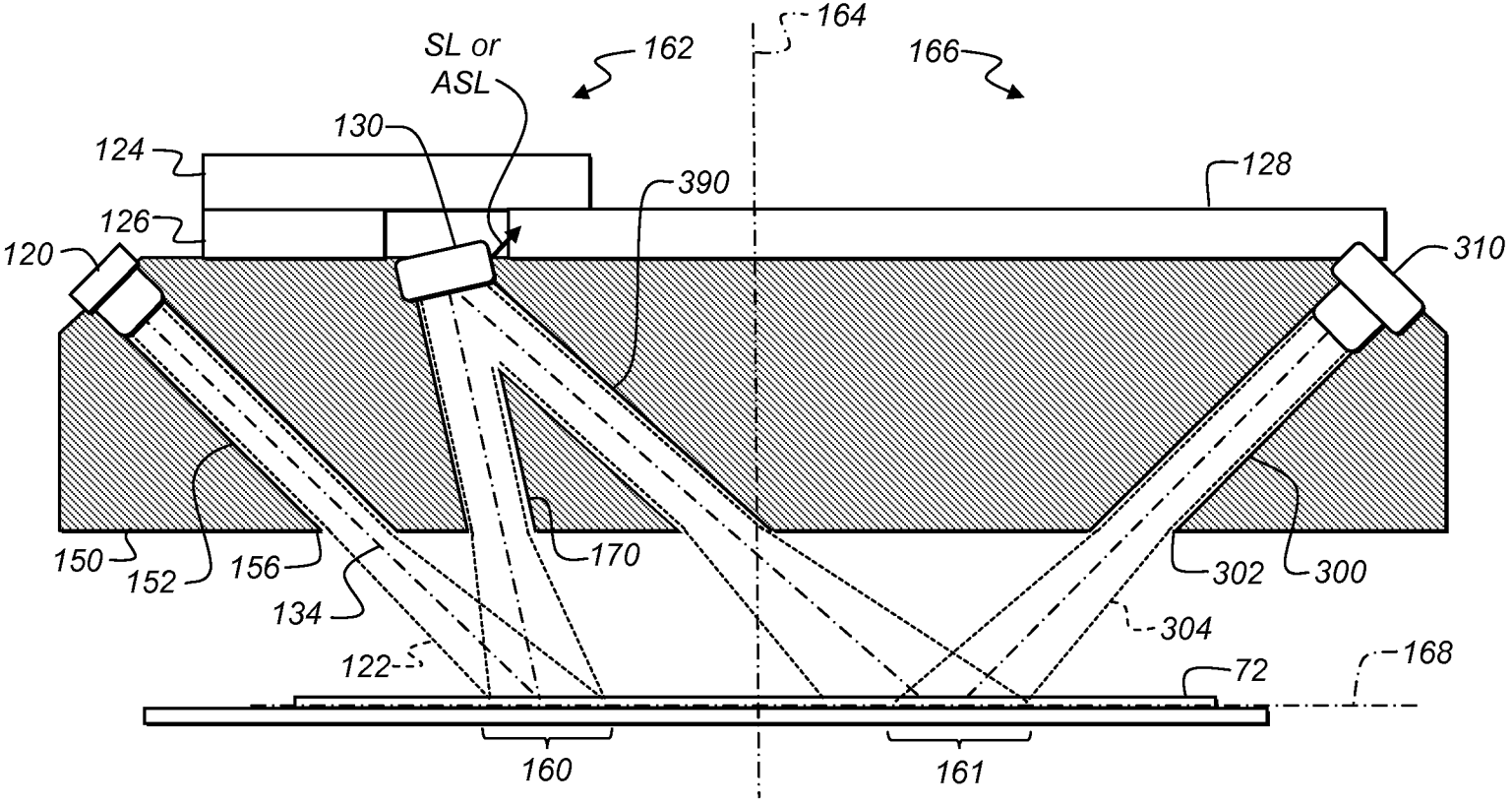
FIG. 10B illustrates still another embodiment of a toner sensing module.

FIGS. 10A and 10B show additional embodiment of toner sensing module 112 using a single light sensor 130 and multiple light sources shown here as first light source 120 and second light source 310.

In the embodiment shown in FIG. 10A, frame 150 has a third bore 300 positioned on second side 166 of a plane 164 that is normal to target area 160 with an opening 322 that receives a second light source 320 and that guides a second light 332 from second light source 320 through an exit 324 to illuminate target area 160. A portion of second light 332 reflects to first light sensor 130 as second reflected light 334. Second light source 320 is connected to light control circuit 126 and, when instructed to do so by light control circuit 126, second light source 320 illuminates target area 160 with a second light 332. Where this is done, second light 332 reflects from target area 160 as second reflected light 334 and travels to first light sensor 130 which generates an alternative light signal ASL that is indicative of the reflection density of fused toner image 72 on receiver 26.

In the embodiment of FIG. 10B toner sensing module 112 has a frame 150 with a first bore 152, a second bore 170, a third bore 300 and a fourth bore 390. In this embodiment first bore 152 and second bore 170 are arranged as is generally described above with reference to FIG. 4, to enable sensing of unfused toner in a target area 160. However, as is also shown in the embodiment of FIG. 10B, third bore 300 has a second light source 310*a* that emits a second light 304 to illuminate a second target area 161 and fourth bore 390 is arranged to guide second light 304 to first light sensor 130. This arrangement allows greater latitude as to the angle of illumination of second target area 161 by second light 304.

It will be appreciated that the embodiments of FIGS. 9, 10A and 10B are optional and provide an alternative way for printer 20 to use a multiple copies of toner sensing module 112 to perform multiple functions including sensing amounts of unfused toner prior to fusing as described above with reference to FIGS. 3-8 as a densitometer 90 after fusing as shown in FIGS. 9 and 10. Optionally, in such an embodiment, frame 150 can have a cylindrical second bore 170 and a third bore 300 arranged such that first light source 120 can be switched between first bore 152 and third bore 300 based upon the function that the toner sensing module 112 is to perform.

In an operation, toner sensing module 112 of the embodiments of FIG. 9, 10A or 10B can have a control system 124 that is adapted to determine whether toner sensing module 112 is to be operated as an unfused toner sensor or is to be operated as a fused toner reflection densitometer. In this regard, control system 124 can have sensors such as switches that can detect a user setting indicating a mode of operation or that detect the presence of a light emitter or a light sensor in second bore 300 and can use the presence of such a light emitter or light sensor which is an indication that the toner sensing module 112 is to be used for reflection density measurements.

Alternatively, control circuit 124 can receive signals from printer controller 82 causing control circuit 124 to operate as an unfused toner sensor or to operate as a reflection density measurement device. In the embodiment of FIG. 9, control circuit 124 can be a circuit that is operable in an unfused toner sensing mode and in a fused toner sensing mode. In the unfused toner sensing mode, control circuit 124 causes first light source 120 to illuminate target area 160 with first light 122 and provides a sensed light signal SL that is based upon an amount of light sensed by first light sensor 130. In the fused toner sensing mode, control circuit 124 causes first light source 120 to generate first light 122 to illuminate target area 160 and provides an alternate sensed light signal ASL that is based upon an amount of a second portion of first light 122 that is reflected as second reflected light 304 and sensed by second light sensor 310.

Similarly, in the embodiment of FIGS. 10A and 10B, control system 124 can be a circuit that is operable in an unfused toner sensing mode and in a fused toner sensing mode. In the unfused toner sensing mode, control system 124 causes first light source 120 to illuminate target area 160 with first light 122 and provides a sensed light signal SL that is based upon an amount of light sensed by first light sensor 130. In the fused toner sensing mode, control system 124 causes second light source 320 to generate second light 332 to illuminate target area 160 and provides an alternate sensed light signal ASL that is based upon an amount of second reflected light 334 sensed by first light sensor 130.

In any of the embodiments of FIGS. 9, 10A and 10B, control system 124 can encode data with or otherwise modify or supplement a sensed light signal SL or alternate sensed light signal ASL so that printer controller 82 can determine a mode of operation of the toner sensing module 112.

In the embodiments that are illustrated in FIGS. 4-10B, frame 150 has been shown and described as being in the form of structure that has a plurality of bores therein to position and to arrange at least one light sensor and at least one light emitter. However, it will be appreciated that in other embodiments frame 150 can take any other form that can position first light source 120, first light sensor 130 and optionally second light sensor 310 and second light source 320 as described and claimed herein, including space frame structures, chassis, mountings or other structures. Further, in general, frame 150 can comprise a collection of separate mounting structures that position these components in the manner that is described or claimed herein and their equivalents.

In the embodiments that have been discussed so far, sensing of an amount of toner in a toner image has been shown as being performed on a receiver 26. However, it will be appreciated that toner sensing module 112 can be used to sense amounts of unfused toner on any surface on which a toner image can be formed or transferred including, but not limited to a primary imaging member and an intermediate transfer system such as transfer subsystem 50.

It will be appreciated that in a toner printer, the toner image is first formed on the primary imaging member and is then transferred to a receiver 26. The toner sensing module 112 of the present invention can be used to sense toner amounts that are recorded either of a primary imaging member or on an intermediate transfer member.

Figure 11:
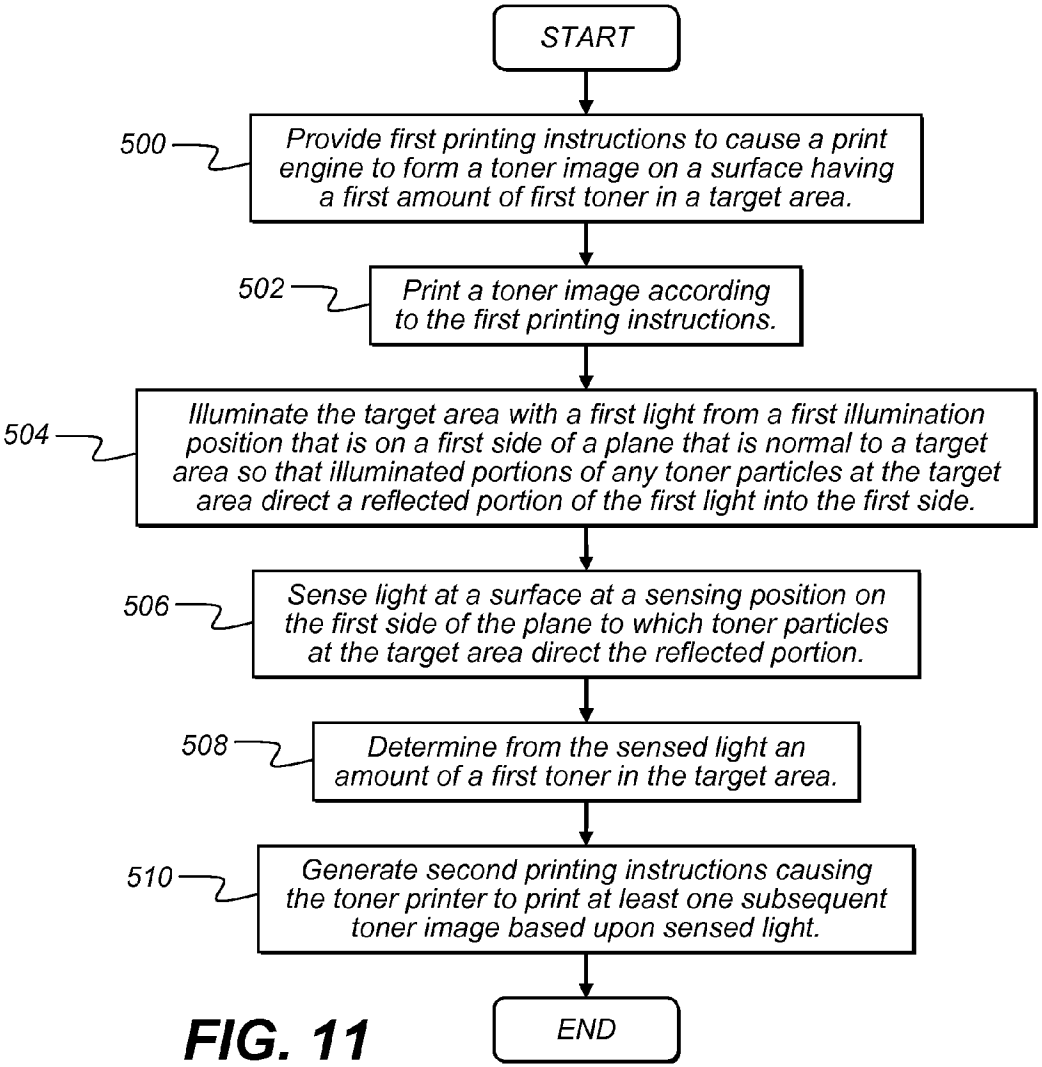
FIG. 11 illustrates a first embodiment of a method for operating a printer.

FIG. 11 illustrates a method for operating a printer such as printer 20 that can be implemented by printer controller 82. As is shown in the embodiment of FIG. 11, first printing instructions are provided to cause a print engine to form a toner image on a surface having first toner in a target area (step 500). A toner image is then printed according to the first printing instructions (step 502) and a target area is illuminated with a first light from a first illumination position that is on a first side of a plane that is normal to a target area so that illuminated portions of any toner particles at the target area reflect a portion of the first light into the first side (step 504). A light is sensed at a surface at a sensing position on the first side of the plane to which toner particles at the target area direct the reflected portion (step 506). These steps can be performed as generally described above and a sensed light signal SL can be provided to printer controller 82.

Printer controller 82 determines, from the sensed light, an amount of a first toner in target area 160 (step 508). This determination is made based upon the intensity of the sensed light and can be made based upon formulae, look up tables, or any other logical association, between an amount of toner in a target area and a sensed light signal.

Correlations between the amount of toner in an area and the sensed light signal can be highly dependent upon specific equipment installations and can be different from printer to printer and over time. Accordingly, such correlations between the amount of toner in a target area and the sensed light signal can be determined based upon experimental, historical, theoretical or heuristic data relating the intensity of sensed light in the target area to an amount of toner therein. In one embodiment, the making of such correlations can involve sampling for example, first reflected light 132 from a target area 160 that has a full application of toner and first reflected light from a target area 160 that has no toner. This defines a range of responses of the system to a range of possible conditions. In one embodiment, the system response to the target area having no toner can be subtracted from readings made so as to factor background noise from the sensed light signal or alternative sensed light signal.

The amount of toner in an area can be determined based upon reflection density measurements or through colorimetric measurements. In other embodiments, an amount of toner mass can be determined through weighing the toner in a toner area and through outer known techniques.

Second printing instructions are then generated causing the toner printer to print at least one subsequent toner image based upon sensed light (step 510). This step can take many forms, in one embodiment this can be done by making adjustments to the print engine so that when a subsequent receiver is passed through the toner printer adjustments are made to the operation of the print engine, to the image data used for printing or to the process for converting image data into printing instructions to cause the print engine to apply toner in amounts that are closer to amounts called for in the printing instructions for printing on the subsequent receiver.

In another embodiment, however, where a toner printer prints a composite image in which multiple toner images are generated in a sequence and are applied in registration to a receiver it is possible to use a sensed light signal to determine second printing instructions that can help to compensate for variations in toner amounts that are found in a first toner image generated for use on a print.

This approach can be used for color compensation. For example, in an image in which the first printing instructions include instructions to form a first color at an area of a print by combining a first amount of a first toner with a second amount of a second toner, a first toner image will be generated having an amount of first toner in the first area. The actual amount of toner at the first area is determined as described above and compared to the first amount of first toner. If there is a discrepancy, then second printing instructions can be generated that are determined to cause the second toner image to have a second amount of toner so that a fused first toner image printed using the first printing instructions and a second toner image printed using the second printing instructions will more closely form the first color than a fused first toner image and second toner image printed using the first printing instructions.

In this way, specific color combinations can be maintained or approximated in an image even where a first color has been applied in a manner that is inconsistent with printing instructions. While in some cases it may not be possible to provide an exact color match using such an approach, it is possible to reduce waste, improve print to print consistency and to reduce machine downtime using such techniques.

In another example of this type, it can be important for various reasons to establish toner stack heights that are within certain ranges. For example, high gloss images require relatively flat fused toner images. However, if there are differences between amounts of toner printed and amounts indicated in printing instructions, relief differentials can arise that can have significantly lower the apparent gloss of the print or that can create distracting glare patterns.

Here too, the availability of a method to sense applied amounts of a first toner can be used to adjust applied amounts of a second later applied toner in order to ensure maintain consistency of toner stack heights.

In one example of this, first printing instructions include instructions to form a first toner stack height by combining an amount of the first toner and an amount of a second toner of an average diameter that is different than average diameter the first toner. The second printing instructions are determined to cause a second toner image to be provided in combination with the first toner image so that a fused first toner image printed using the first printing instructions and a second toner image printed using the second printing instructions more closely forms the first toner stack height than a fused first toner image and second toner image printed using the first printing instructions.

Many other examples of situations where direct measurement of first toner amounts can enable compensatory second toner amounts to be applied to a receiver are possible. These include but are not limited to generating second printing instructions to match optical density or to ensure that desired ratios of toners are provided such as where a combination of two toners of different viscosity are combined to achieve a desired glossiness.

In one embodiment, a panchromatic first light source 120 can be used to generate either first light 122 or second light 332 and a panchromatic type first light sensor 130 or second light sensor 310 can be used having at least three sensing areas that can sense the light that reflects from a target area 160 in at least three colors such as the primary colors of red, green and blue. Such primary colors will not necessarily correspond to the color of a toner printed by the toner printer 20 or to a color formed by a combination of different colors printed by the toner printer. However, some weighted combination of these primary colors will correspond to the color of the toner or to a color that is formed by a combination of toners.

In such an embodiment, printer controller 82 or control circuit 124 can apply a weighting of the signals received from the three different sensing areas that corresponds to a color of the toner or to the combination of the toners. This effectively reduces the extent to which a sensed light signal or an alternative light signal is influenced by reflected light that is of a color that is unrelated to a color of interest and improves the signal to noise ratio of the sensed light signal or the alternative light signal.

Optionally, in an embodiment where reflective densitometry is performed using for example the embodiments of FIG. 9, 10A, or 10B the weighting can be made according to a complimentary color of a toner or combination of toners at a target area. This approach can also effectively reduce the extent to which a sensed light signal or an alternative light signal is influenced by reflected light that is of a color that is unrelated to a color of interest and can improve the signal to noise ratio of the sensed light signal or the alternative light signal.

Figure 12:
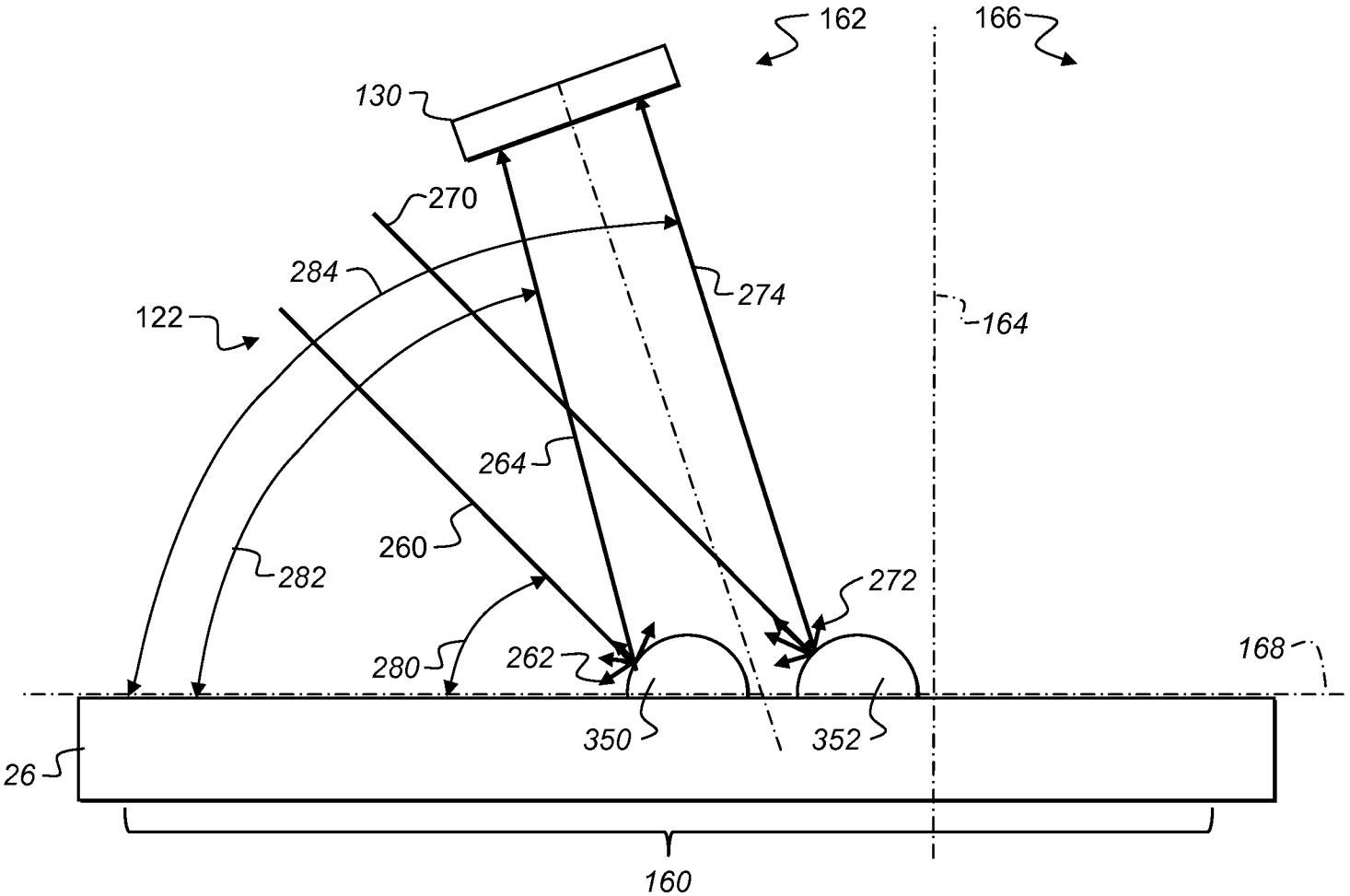
FIG. 12 illustrates the use of the toner sensing module with toner that is applied to a receiver in non-solid form.

In the preceding examples, toner printers have been described as providing toner in a single phase solid particle form. However, it will be appreciated that in other embodiments, toner printer 20 can include modules for jetting a melted toner in a liquid form toward a receiver such that the toner solidifies in contact with the receiver. As is shown in FIG. 12, where this is done, target area 160 can have liquid toner applied thereto that cools to form hemi-spherical, hemi-spheroid, amorphous, blob like or other toner particles such as toner particles 350 and 352. As is shown in FIG. 12, after cooling such particles can have stable rounded surfaces which, when illuminated by a first light 122 can cause reflections such as those described above with reference to FIG. 9. Accordingly, toner sensing module 112 can be used with a toner printer 20 having a print engine 22 that generates toner patterns in such a fashion.

The invention has been described in detail with particular reference to certain preferred embodiments thereof, but it will be understood that variations and modifications can be effected within the spirit and scope of the invention.

What is claimed is:

1. A toner printer comprising:

a print engine;

a controller providing first printing instructions to cause the print engine to form a first toner image on a surface having a first toner in a target area and causing the print engine to print the first toner image according to the first printing instructions, wherein the first printing instructions include instructions to form a first toner stack height by combining an amount of the first toner and an amount of a second toner of an average diameter that is different than an average diameter of the first toner;

a first light source illuminating the target area of the printed first toner image with a first light from a first illumination position that is on a first side of a plane that is normal to the target area; and a first light sensor sensing light at a sensing position on the first side of the plane to which toner particles at the target area direct a reflected portion of the first light into the first sensor;

wherein the controller determines from the sensed light an amount of the first toner in the target area and generates second printing instructions causing the print engine to print at least one subsequent toner image based upon the sensed light, wherein the second printing instructions are determined to cause a second toner image to be provided in combination with the first toner image so that a fused toner image combining the first toner image printed using the first printing instructions and the second toner image printed using the second printing instructions more closely forms the first toner stack height than a fused first toner image and second toner image printed using the first printing instructions.

2. The printer of claim 1, wherein the first illumination position is such that the first light travels to the target area at an illumination angle that is between about 40 to about 50 degrees measured with respect to the surface of the target.

3. The printer of claim 1, wherein the first light sensor is positioned to sense the reflected first light at a sensing angle that is from about 80 degrees to less than 90 degrees measured with respect to the target area.

4. The printer of claim 1, wherein the first illumination position is at an illumination angle relative to the target area so that portions of the first light that reflect from a surface in the target area predominantly reflect in a specular manner and travel into the second side.

5. The printer of claim 1, wherein the first light is monochromatic and the first light sensor is monochromatic and both are similar in color to the colorant of the toner.

6. The printer of claim 1, wherein the first light is multi-monochromatic and the first light sensor is multi-monochromatic and both are similar in color to the colorants of the toner.

7. The printer of claim 1, wherein the first light source is a panchromatic light source and wherein the first light is a panchromatic light.

8. The printer of claim 1, wherein the first light sensor is a panchromatic light sensor having at least three different sensors adapted to sense different colors and wherein the sensed light signal is indicative of the exposure of the different sensors to components of the reflected light.

9. The printer of claim 8, wherein the first light is a panchromatic light and the first light sensor to provides a sensed light signal indicative of the response of the at least three different sensors to the reflected portion of the panchromatic first light weighted to match a color.

10. The printer of claim 1, further comprising a second light source that emits a second light and that directs the second light to illuminate the target area so that portions of the second light reflect from the target area to the first light sensor in a specular manner and a controller that causes only one of the first light source and the second light source to illuminate the target at any given time.

11. The printer of claim L further comprising a control circuit operable in an unfused toner sensing mode to cause the first light source to illuminate the target area and to cause the first light sensor to sense the first light reflected from the target area to the first light sensor, wherein the control circuit is alternatively operable in a fused toner sensing mode to cause the first light source to illuminate the target plane and to cause a second light sensor positioned by a frame on a second side of the plane to sense second reflected light from the target area.

12. The printer of claim 11, wherein the control circuit generates a sensed light signal based upon light sensed by the first light sensor in the unfused toner sensing mode and generates an alternate sensed light signal in the second mode based upon the light sensed by the second light sensor when in the fused toner sensing mode.

13. The printer of claim 1, further comprising a second light sensor that generates a second sensed light signal that is indicative of an exposure to a second light positioned by a frame so that portions of the first light that reflect from the target area in a specular manner illuminate the second light sensor.

14. The printer of claim 13, further comprising a control circuit operable in an unfused toner sensing mode to cause the first light source to illuminate the surface and to cause the first light sensor to sense the first light reflected wherein the control circuit is also operable in a fused toner sensing mode to cause the second light source to illuminate the target area and to cause the second light sensor to sense reflected light from the target area.

15. The printer of claim 14, wherein the control circuit generates a sensed light signal based upon light sensed by the first light sensor in the unfused toner sensing mode and generates an alternate sensed light signal based upon the light sensed by the second light sensor when in the fused toner sensing mode.

16. The printer of claim 14, wherein the toner sensing module is in a path of movement of the toner image and the receiver through the printer that is after the fuser.

17. The printer of claim 1 further comprising an intermediate transfer member that carries a toner image from a primary imaging member to a receiver, and wherein the target area is on the intermediate transfer member.

18. The printer of claim 1, wherein the toner image is transferred by a toner printing module to a receiver and wherein the target area is on a path taken to move the toner image and the receiver from the printing module to a fuser.

19. The printer of claim 1, further comprising a primary imaging member on which the toner image is formed and wherein the target area is on the primary imaging member.

20. A toner printer comprising:

a print engine;

a controller providing first printing instructions to cause the print engine to form a first toner image on a surface having a first toner in a target area and causing the print engine to print the first toner image according to the first printing instructions, wherein the first printing instructions include instructions to form a first color by combining an amount of the first toner and an amount of a second toner of a color that is different than the first toner;

a first light source illuminating the target area of the printed first toner image with a first light from a first illumination position that is on a first side of a plane that is normal to the target area; and a first light sensor sensing light at a sensing position on the first side of the plane, and to which toner particles at the target area direct a reflected portion of the first light into the first sensor;

wherein the controller determines from the sensed light an amount of the first toner in the target area and generates second printing instructions causing the print engine to print at least one subsequent toner image based upon the sensed light, wherein the second printing instructions are determined to cause a second toner image to be provided in combination with the first toner image so that a fused toner image combining the first toner image printed using the first printing instructions and the second toner image printed using the second printing instructions will more closely form the first color than a fused first toner image and second toner image printed using the first printing instructions.

* * * * *